US009366104B2

(12) United States Patent
Obrejanu

(10) Patent No.: US 9,366,104 B2
(45) Date of Patent: Jun. 14, 2016

(54) DOWNHOLE TUBING ROTATORS AND RELATED METHODS

(71) Applicant: Premium Artificial Life Systems Ltd., Calgary (CA)

(72) Inventor: Marcel Obrejanu, Calgary (CA)

(73) Assignee: Premium Artificial Lift Systems Ltd., Calgary (CA)

( * ) Notice: Subject to any disclaimer, the term of this patent is extended or adjusted under 35 U.S.C. 154(b) by 488 days.

(21) Appl. No.: 13/800,858

(22) Filed: Mar. 13, 2013

(65) Prior Publication Data

US 2014/0262342 A1 Sep. 18, 2014

(51) Int. Cl.
*E21B 33/04* (2006.01)
*E21B 23/01* (2006.01)
*E21B 43/12* (2006.01)

(52) U.S. Cl.
CPC ..... *E21B 33/0415* (2013.01); *E21B 23/01* (2013.01); *E21B 43/126* (2013.01)

(58) Field of Classification Search
CPC ..... E21B 17/05; E21B 4/02; E21B 7/002; E21B 23/01; E21B 4/20; E21B 17/02
See application file for complete search history.

(56) References Cited

U.S. PATENT DOCUMENTS 5,642,782 A 7/1997 Grimshaw et al.
2006/0011339 A1 1/2006 Wright et al.
2009/0114400 A1 5/2009 Obrejanu
2010/0101779 A1 4/2010 Obrejanu
2012/0031676 A1* 2/2012 Comeau et al. ..... 175/61

FOREIGN PATENT DOCUMENTS

CA 2474418 1/2006

OTHER PUBLICATIONS

"Down-hole Tubing Rotator", Millennium Oilflow Systems & Technology Inc., Copyright 2013, 2 pages, <http://mostoil.com/products/down-hole-tubing-rotator/>.
"Ball Reverser Actuator", Norco Inc. Flennor Power Transmission Products, Copyright 2000, 6 pages, <http://www.motiontech.com.au/assets/pdf/Flennor%20Norco%20Ball%20Reverser%20Actuator%20230712.pdf>.
Search Report and Written Opinion issued May 29, 2014 with respect to International PCT Patent Application No. PCT/CA2014/050190 (7 pages).

* cited by examiner

*Primary Examiner* — Elizabeth Gitlin
(74) *Attorney, Agent, or Firm* — Senniger Powers LLP

(57) ABSTRACT

A mandrel harnesses torque from a progressing cavity pump stator to which it is coupled. Operation of the pump rotor induces a torque on the pump stator, and that torque is harnessed by the mandrel. A rate of rotation of the mandrel due to the torque from the pump stator is controlled, and the rotation rate is hydraulically reduced in an embodiment. A rotation in a direction opposite to a direction of rotation of the mandrel due to the torque from the pump stator is applied to a production tubing string. The direction of rotation of the mandrel could be reduced and applied to the production tubing string by a planetary gear system, for example.

22 Claims, 7 Drawing Sheets

DOWNHOLE TUBING ROTATORS AND RELATED METHODS

FIELD OF THE INVENTION

This invention relates generally to downhole equipment for production wells and, in particular, to downhole tubing rotators.

BACKGROUND

In production wells, erosion can occur at a point of contact between a sucker rod string and an inside surface of a production tubing string. A tubing rotator that is installed at the surface, as part of a wellhead, is supplied with energy and slowly turns the tubing string from the surface all the way to a tubing swivel installed above a downhole pump that is operated by the sucker rod string. Tubing rotators typically turn the tubing string to the right (right hand rotation) to distribute any erosion due to sucker rod string contact around the inner surface of the production tubing string.

SUMMARY

A downhole tubing rotator includes a mandrel to be coupled to a progressing cavity pump stator; a rotation control module coupled to the mandrel, to control a rate of rotation of the mandrel due to torque applied to the mandrel by the progressing cavity pump stator; an anchor module coupled to the mandrel to anchor the downhole tubing rotator to a well casing; a rotation reversing module coupled to the mandrel, to apply to a tubing string a rotation in a direction opposite to a direction of rotation of the mandrel due to the torque applied to the mandrel by the progressing cavity pump stator; a swivel module to be coupled to the tubing string to allow the tubing string to rotate independently of the anchor module.

In an embodiment, the rotation control module includes a sleeve coupled to move with rotation of the mandrel; a resistance arrangement to apply resistance to movement of the sleeve.

The sleeve could be coupled to the mandrel by ball bearings, with one of the mandrel and the sleeve comprising ball races, and the ball bearings running along the ball races during rotation of the mandrel in the ball races.

The ball races could translate the rotation of the mandrel into oscillating longitudinal movement of the sleeve along the mandrel. In an embodiment, the sleeve includes lugs that engage cutouts in the downhole tubing rotator to prevent rotation of the sleeve with the mandrel. The cutouts could be cutouts in an anchor mandrel of the anchor module, for example.

The resistance arrangement could include a first hydraulic chamber and a second hydraulic chamber and a flow restrictor on the sleeve, coupling the first hydraulic chamber and the second hydraulic chamber. The sleeve could then force hydraulic fluid between the first hydraulic chamber and the second hydraulic chamber through the flow restrictor as the sleeve moves with rotation of the mandrel.

In an embodiment, the resistance arrangement also includes a second flow restrictor on the sleeve, coupling the first hydraulic chamber and the second hydraulic chamber, and the flow restrictor and the second flow restrictor are unidirectional flow restrictors. The flow restrictor enables restricted flow of the hydraulic fluid in a first direction between the first hydraulic chamber and the second hydraulic chamber, and the second flow restrictor enables restricted flow of the hydraulic fluid between the first hydraulic chamber and the second hydraulic chamber in a second direction opposite the first direction. With the rotation control module translating the rotation of the mandrel into oscillating longitudinal movement of the sleeve along the mandrel, the sleeve alternately forces the hydraulic fluid between the first hydraulic chamber and the second hydraulic chamber through the flow restrictor in the first direction and through the second flow restrictor in the second direction as the sleeve moves with rotation of the mandrel.

Another embodiment that includes a first hydraulic chamber and a second hydraulic chamber also has a flow path coupling the first hydraulic chamber and the second hydraulic chamber, with the ball bearings being located in the flow path. The sleeve then forces hydraulic fluid between the first hydraulic chamber and the second hydraulic chamber through the flow path as the sleeve moves with rotation of the mandrel.

The rotation reversing module could include a planetary gear system between the mandrel and a top sub of the swivel module, which is to be coupled to the tubing string. In an embodiment, the planetary gear system includes a central gear coupled to the mandrel; an outer gear coupled to the top sub; planet gears that mesh with the central gear and the outer gear. The central gear could include a planetary drive sub coupled to the mandrel. The outer gear could be a gear formed in an inner surface of a housing coupled to the top sub. A gear reduction ratio could be provided by the planetary gear system to rotate the top sub at a lower rate of rotation than the rate of rotation of the mandrel.

A method is also disclosed, and includes coupling a mandrel of a downhole tubing rotator to a production well progressing cavity pump stator; anchoring the downhole tubing rotator to a well casing; controlling a rate of rotation of the mandrel due to torque applied to the mandrel by the progressing cavity pump stator; applying to a tubing string a rotation in a direction opposite to a direction of rotation of the mandrel due to the torque applied to the mandrel by the progressing cavity pump stator.

The controlling could involve applying resistance to the rotation of the mandrel. In an embodiment, this applying resistance involves translating the rotation of the mandrel into oscillating longitudinal movement of the sleeve along the mandrel; applying the resistance to the oscillating longitudinal movement of the sleeve.

The controlling could involve hydraulically reducing the rate of rotation of the mandrel, such as by forcing hydraulic fluid between a first hydraulic chamber and a second hydraulic chamber through a flow restrictor as the mandrel rotates.

In an embodiment, applying rotation to the tubing string involves driving a central gear of a planetary gear system with the mandrel; driving an outer gear, coupled to the tubing string, with planet gears that mesh with the central gear and the outer gear.

Another method involves providing a mandrel to be coupled to a progressing cavity pump stator; coupling a rotation control module to the mandrel, to control a rate of rotation of the mandrel due to torque applied to the mandrel by the progressing cavity pump stator; coupling an anchor module to the mandrel to anchor the mandrel to a well casing; coupling a swivel module to a tubing string to allow the tubing string to rotate independently of the anchor module; coupling a rotation reversing module to the mandrel and to the swivel module, to apply to the tubing string a rotation in a direction opposite to a direction of rotation of the mandrel due to the torque applied to the mandrel by the progressing cavity pump stator.

According to another aspect of the present disclosure, production well downhole equipment includes a mandrel to be coupled to a progressing cavity pump stator; a rotation control module to be coupled to the mandrel, to control a rate of rotation of the mandrel due to torque applied to the mandrel by the progressing cavity pump stator; a rotation reversing module to be coupled to the mandrel and a tubing string, to apply to the tubing string a rotation in a direction opposite to a direction of rotation of the mandrel due to the torque applied to the mandrel by the progressing cavity pump stator.

Other aspects and features of embodiments of the present disclosure will become apparent to those ordinarily skilled in the art upon review of the following description.

BRIEF DESCRIPTION OF THE DRAWINGS

Examples of embodiments of the invention will now be described in greater detail with reference to the accompanying drawings.

i.

ii.

iii.

iv.

v.

vi.

vii.

viii.

ix.

x.

xi.

xii.

xiii.

xiv.

xv.

DETAILED DESCRIPTION

A downhole tubing rotator as disclosed herein works in conjunction with, and is powered by, a downhole progressing cavity (PC) pump, to continuously rotate the tubing string at a controlled rate of rotation. This rotation of the tubing string prevents excessive wear of the production tubing string, at the points of contact with the sucker rod string. Torque generated by the downhole PC pump is harnessed and used to rotate the production tubing string from the PC pump all the way to surface.

In an embodiment, a downhole tubing rotator has a modular design with interchangeable modules to address different well configurations. These modules include:

1. an RPM (Rotations Per Minute) control module, also referred to herein as a rotation control module, that harnesses torque energy from the PC pump and hydraulically reduces the RPM of the production tubing rotation;
2. a torque anchor module, that anchors the torque generated by the PC pump to the well casing and allows the harnessing of this torque energy that is otherwise wasted, for the production tubing string rotation;
3. a swivel module that connects to the production tubing string to allow the tubing string rotation;
4. a rotation reversing module that reverses the rotation caused by the PC pump, to allow the rotation of the production tubing string in the opposite direction, and avoid tubing back-off. The rotation reversing module might also act as a gear reducer to further reduce the RPM of the production tubing string relative to the mandrel.

At the surface, the production tubing string could be suspended by a rotating tubing hanger or by a tubing swivel installed under a tubing hanger.

Figure 1C:
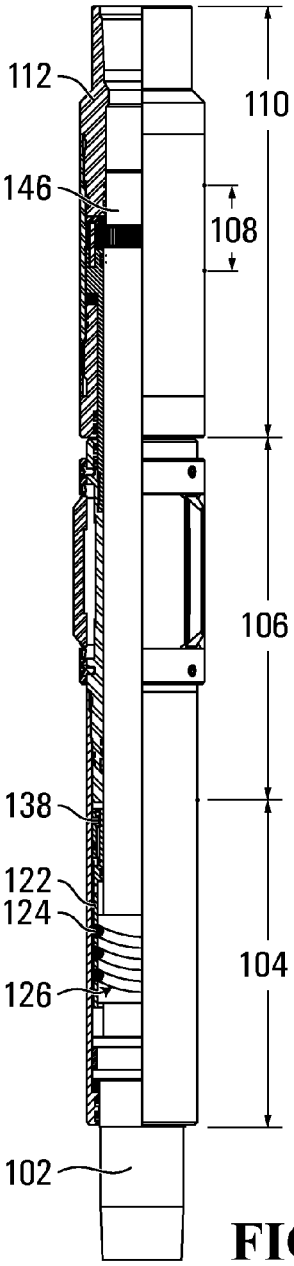
FIG. 1C is a cross-section view of the example downhole tubing rotator along line 1C-1C in FIG. 1B, with the exception of the mandrel 102 and the planetary drive sub 146, which have not been sectioned in order to better illustrate certain features.
Figure 1A:
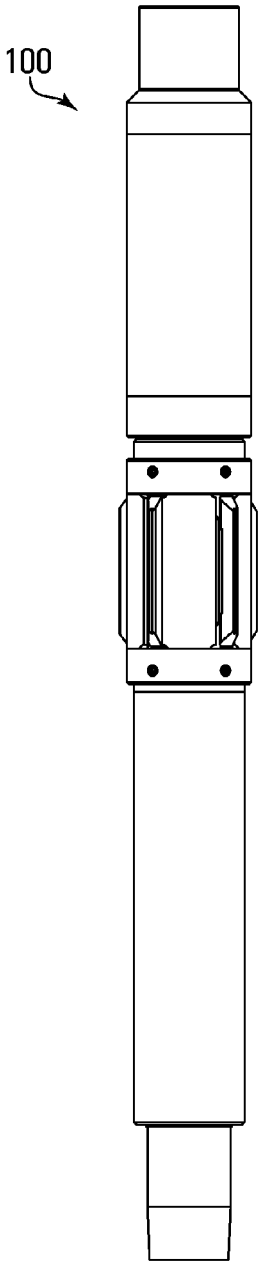
FIG. 1A is a side view of an example downhole tubing rotator.
Figure 1B:
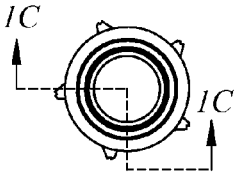
FIG. 1B is an end view of the example downhole tubing rotator.
Figure 3:
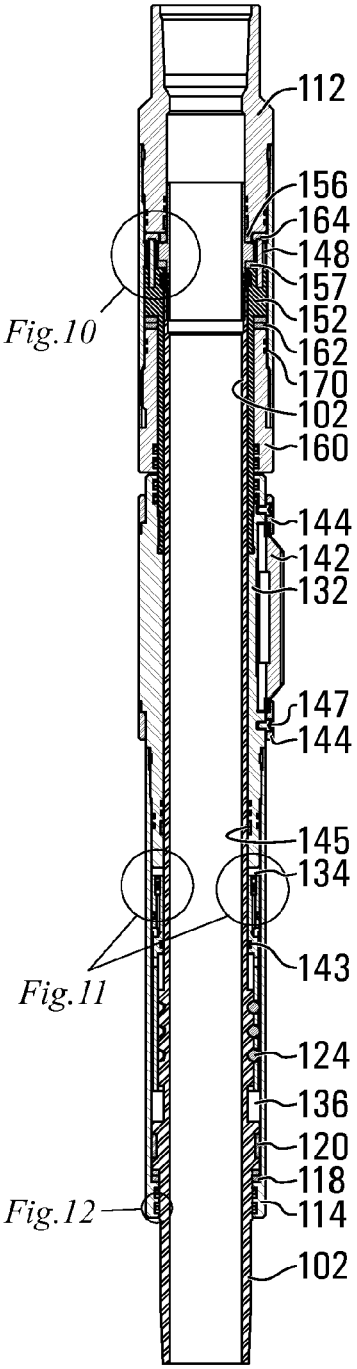
FIG. 3 is a cross-section view of the example downhole tubing rotator along line 3-3 in FIG. 2.
Figure 4:
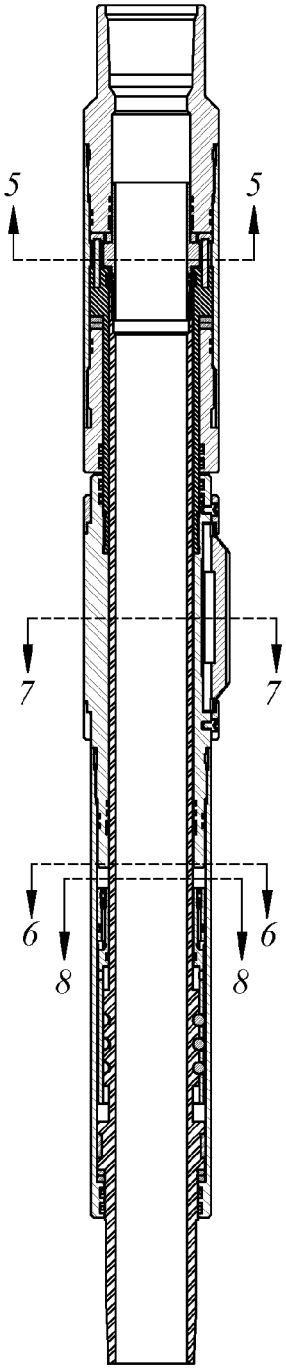
FIG. 4 is a cross-section view of the example downhole tubing rotator along line 3-3 in FIG. 2, with the mandrel rotated 90° relative to the position of the mandrel shown in FIG. 3.

With reference now to the drawings, FIGS. 1A to 1C show relatively high-level views of an example downhole tubing rotator 100, and the other drawings show various parts of the example downhole tubing rotator in detail. The example downhole tubing rotator 100 includes a mandrel 102 to be connected to a PC pump stator, a rotation control module 104, an anchor module 106, a rotation reversing module 108, and a swivel module 110.

In operation, when a PC pump rotor is rotated by a sucker rod string, the PC pump stator connected to the mandrel 102 is subject to a torque in the direction of the rotor rotation. This torque is transmitted to the mandrel 102 which is connected to the PC pump stator. The rotation control module 104 is operatively coupled to the mandrel 102 to control a rate of rotation of the mandrel due to the torque that is applied to the mandrel by the PC pump stator. The rotation reversing module 108 is also operatively coupled to the mandrel 102, to apply to the production tubing string a rotation in a direction opposite to a direction of rotation of the mandrel due to the torque applied to the mandrel by the PC pump stator. The anchor module 106 anchors the example downhole tubing rotator to a production well casing, and the swivel module 110 allows the production tubing string, which would be connected to a top sub 112, to rotate independently of the anchor module 106.

The foregoing description and FIGS. 1A to 1C provide a general overview of the example downhole tubing rotator 100 and its operation. Further example details are described below, and the reference numbers appearing below may be shown in one or more of FIGS. 2 to 18.

A downhole tubing rotator as disclosed herein is driven by a PC pump stator, which would be connected to the mandrel 102 in the example downhole tubing rotator 100. Thus, the example downhole tubing rotator 100 will be further described starting from a lower end of the mandrel 102, which is at an opposite end of the example downhole tubing rotator relative to the top sub 112.

The mandrel 102 is supported at its lower end by a housing 114. Seals 116 seal the housing against the mandrel 102, and two lower seals are shown in the example downhole tubing rotator 100. More or fewer seals could be provided in other embodiments. A bearing ring 118 allows relative rotation between the mandrel 102 and a lower shoulder or radial support surface of the housing 114, and a glide ring 120 allows relative rotation between the mandrel 102 and an inside an inner axial surface of the housing 114. The glide ring 120, also known in the industry as a wear ring, is installed between two moving components to maintain a certain gap or clearance between those components and prevent wear or galling of the components.

As part of the rotation control module 104 in the example shown, a cylindrical sleeve 122 is operatively coupled to the mandrel 102, to move with rotation of the mandrel. The operative coupling between the mandrel 102 and the sleeve 122 in this example is through ball bearings 124. The ball bearings run in ball races 126 as the mandrel 102 rotates, and remain captive between the ball races and an inner wall of the housing 114, and in holes along a side of the sleeve 122. In the example downhole tubing rotator 100, the ball races 126 are in an outer surface of the mandrel 102 and the holes are in the sleeve 122, although in other embodiments the ball races could be formed in an inner surface of the sleeve, with detents or spherical cavities in the outer surface of the mandrel.

The ball races 126 have an undulating pattern, which translates rotation of the mandrel 102 into oscillating longitudinal movement of the sleeve 122 along the mandrel. This can be seen, for example, by comparing FIGS. 3 and 4. The ball bearings 124 and the sleeve 122 are lower in FIG. 4 than in FIG. 3, and as noted above the mandrel 102 is rotated 90° (a quarter turn) in FIG. 4 relative to the position of the mandrel shown in FIG. 3. Thus, as the mandrel 102 rotates, the sleeve 122 oscillates back and forth along the mandrel.

On the sleeve 122, lugs 128 engage complementary cutouts 130 to prevent rotation of the sleeve with the mandrel 102. Two lugs 128, 180° apart and at a top of the sleeve 122, are shown in the example downhole tubing rotator 100, engaging cutouts 130 in an anchor mandrel 132. The lugs 128 and the cutouts 130 could be reversed in another embodiment, with the lugs being provided on the anchor mandrel 132 and the cutouts being provided in the sleeve 122.

A resistance arrangement applies resistance to the movement of the sleeve 122, to reduce the rate of rotation of the mandrel 102. This resistance hydraulically reduces the rate of rotation in one embodiment, and in the example downhole tubing rotator 100, the resistance arrangement involves a first hydraulic chamber 134 and a second hydraulic chamber 136. These hydraulic chambers 134, 136 are annular chambers between the mandrel 102 and the housing 114. The first hydraulic chamber 134 is also bordered by a bottom edge of the anchor mandrel 132 in the example shown. In the sleeve 122, flow restrictors 138, 140, which are illustratively check valves, are located in a flow path between the hydraulic chambers 134, 136.

Seals 141, 143 prevent the flow of hydraulic fluid between the upper and lower hydraulic chambers 134, 136 around the sleeve 122 instead of through the flow path that includes the flow restrictors 138, 140. The outer seal 141 seals the gap between the sleeve 122 and the housing 114, and the inner seal seals the gap between the sleeve and the mandrel 102. Oscillating movement of the sleeve 122 with rotation of the mandrel 102 forces hydraulic fluid between the hydraulic chambers 134, 136 through the flow restrictors 138, 140. The flow restrictors 138, 140 restrict flow of the hydraulic fluid between the chambers through a flow channel 127 which is in fluid communication with the first and second hydraulic chambers 134, 136. In the example shown, a flow channel 127 is provided on each side of the sleeve 122, 180° apart, illustratively by milling the flow channels into an outside surface of the sleeve. Each flow channel 127 is in fluid communication with the upper hydraulic chamber 134 through a port 123 and a bore in the sleeve 122 which holds a flow restrictor 138, 140, and is in direct fluid communication with the lower hydraulic chamber 136. A pressure relief port 125 may also be provided on each side of the sleeve 122 to prevent hydraulic locking of the sleeve.

The flow restrictors 138, 140 apply resistance to the flow of hydraulic fluid between the hydraulic chambers 134, 136, and thus applies resistance against the oscillating movement of the sleeve 122, which in turn applies resistance to rotation of the mandrel 102, controlling a rate of rotation of the mandrel. In an embodiment, the flow restrictors 138, 140 are unidirectional, with one flow restrictor enabling restricted flow of hydraulic fluid from one hydraulic chamber 134, 136 to the other, and the other flow restrictor enabling restricted flow of hydraulic fluid in the opposite direction between the hydraulic chambers. As the sleeve 122 oscillates, it alternately forces the hydraulic fluid between the hydraulic chambers 134, 136 through one flow restrictor 138, 140 in a first direction and through the other flow restrictor in a second, opposite direction.

Figure 15:
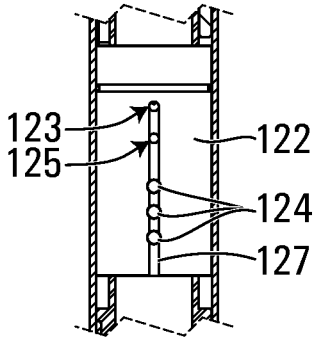
Figure 16:
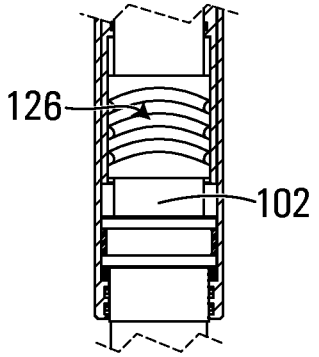
Figure 13:
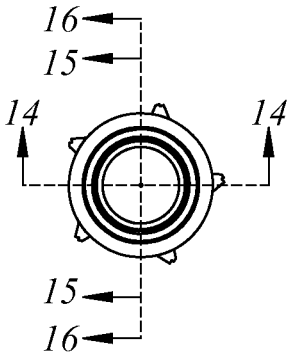
FIG. 13 is another end view of the example downhole tubing rotator.
Figure 17:
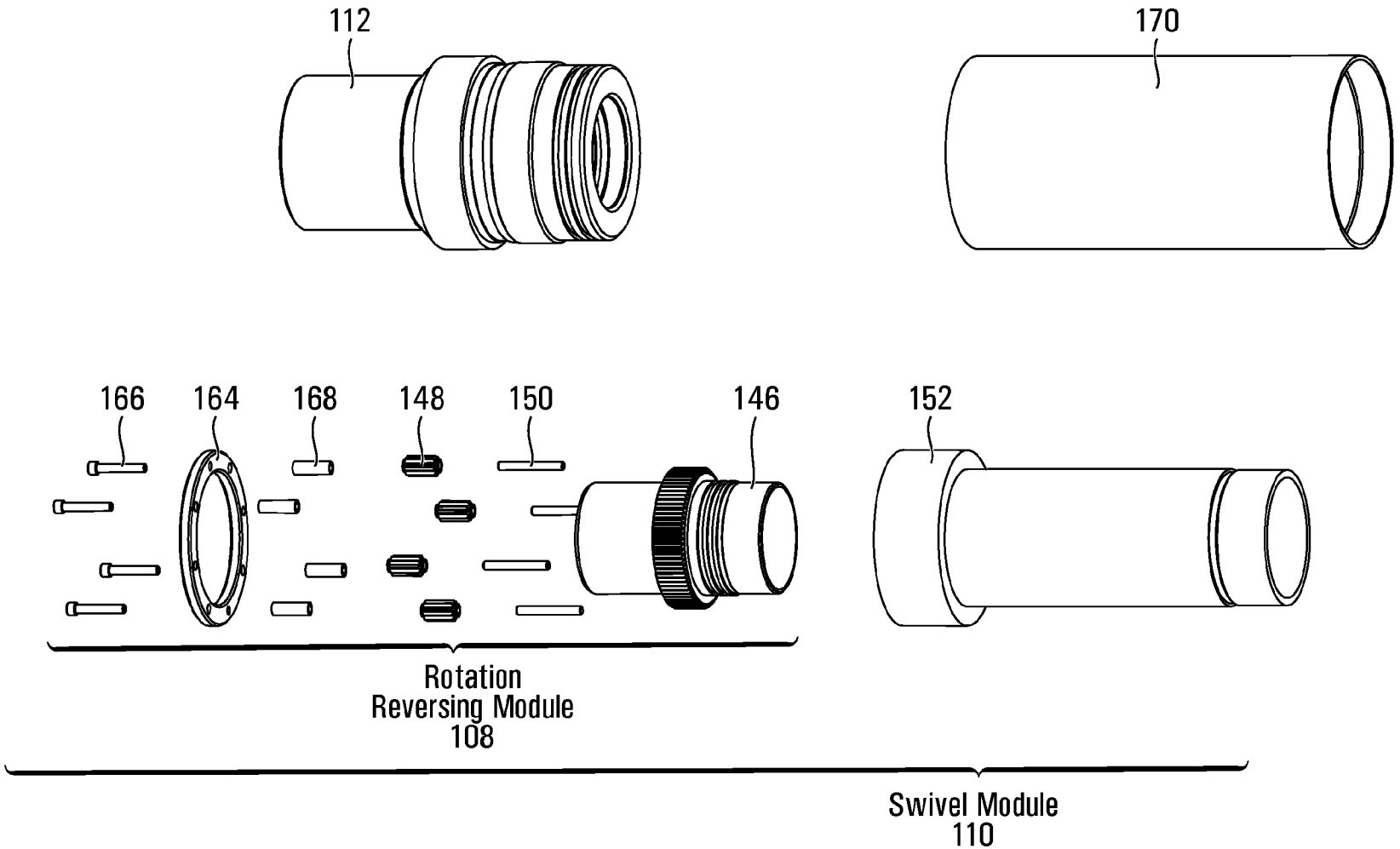
FIG. 17 is an exploded view of a swivel module of the example downhole tubing rotator.
Figure 18:
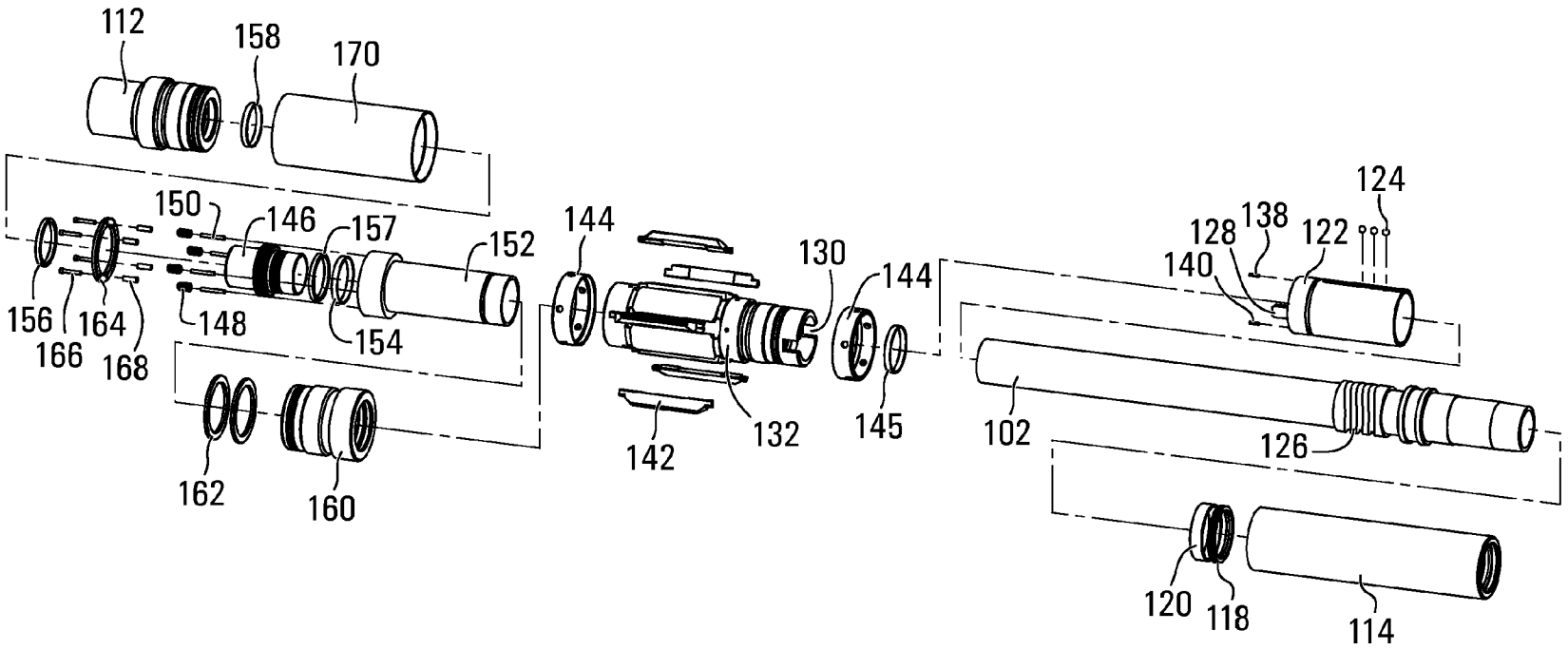
FIG. 18 is an exploded view of the example downhole tubing rotator.

As shown perhaps most clearly in FIG. 15, the ball bearings 124 could be located in a flow path between the hydraulic chambers 134, 136, and in this example in the flow channel 127 on one side of the sleeve 122. The flow of hydraulic fluid through this flow channel 127 as the sleeve 122 oscillates with rotation of the mandrel 102 then also lubricates and cleans the ball bearings 124.

The anchor module 106 includes the anchor mandrel 132, anchor blocks 142, and retaining rings 144 which attach to the anchor mandrel with screws 147 in the embodiment shown, and hold the anchor blocks in place. Rotation of the anchor mandrel 132 in one direction sets the anchor blocks 142 against the inner surface of a well casing, and rotation of the anchor mandrel in the opposite direction releases the anchor blocks. In an embodiment, the anchor module 106 is a downhole anchor assembly as disclosed in U.S. patent application Ser. No. 12/257,826, entitled "MULTIPLE-BLOCK DOWNHOLE ANCHORS AND ANCHOR ASSEMBLIES", filed Oct. 24, 2008, issued Mar. 8, 2011 as U.S. Pat. No. 7,900,708, incorporated in their entireties herein by reference.

An upper end of the housing 114 is attached to the anchor mandrel 132. This attachment could be through screws or other fasteners, which have not been shown in order to avoid congestion in the drawings, or threaded connections, for example. A glide ring 145 allows relative rotation between an outer surface of the mandrel 102 and an inner surface of the anchor mandrel 132.

In the rotation reversing module 108, a planetary drive sub 146 is coupled to the mandrel 102, and threads onto an upper end of the mandrel in the example shown. The planetary drive sub 146 is the central gear in a planetary gear system between the mandrel 102 and the top sub 112. The planetary gear system also includes planet gears 148, which rotate on pinion pins 150 carried by a pinion retainer 152. The upper end of the mandrel 102 is inside the pinion retainer 152. A lower planetary drive sub bearing 157 allows relative rotation between the planetary drive sub 146 and an upper radial surface of the pinion retainer 152, and a glide ring 154 allows relative rotation between the mandrel 102, inside which the planetary drive sub 146 is threaded in an embodiment, and an inner axial surface of the pinion retainer. An upper planetary drive sub bearing 156 allows relative rotation between the planetary drive sub 146 and a lower radial surface of the top sub 112, and a further glide ring 158 allows relative rotation between the planetary drive sub 146 and an inner axial surface of the top sub 112.

The example downhole tubing rotator 100 also has a bearing retainer 160 outside the outer axial surface of the pinion retainer 152 and between an upper end of the anchor mandrel 132 and a lower radial surface of an upper flange of the pinion retainer 152. The pinion retainer 152 is threaded into the anchor mandrel 132 in an embodiment, and the bearings 162 allow relative rotation between the pinion retainer 152 and the bearing retainer 160, which is attached to the housing 170. The swivel module 110 can thus be rotated relative to the pinion retainer 152 and accordingly the anchor module 106 to which the pinion retainer is coupled. A radial surface of the planetary drive sub 146 rests on an upper radial surface of the upper flange of the pinion retainer 152 and provides further support for the mandrel 102.

In the example shown, the planet gears 148 are held in place on the pinion pins 150 and against the pinion retainer 152 by a planetary back plate 164 and screws 166. Spacing between the planetary back plate 164 and the pinion retainer 152 is maintained by planetary cage spacers 168 in the example shown. The screws 166 pass through central bores or holes through the planetary back plate 164 and the planetary cage spacers 168, and into bores or holes in the upper flange of the pinion retainer 152. These bores or holes in the upper flange of the pinion retainer 152 could, but need not, pass entirely through the upper flange.

Figure 5:
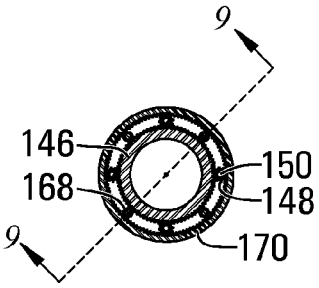
FIGS. 5 to 8 are cross-section views of the example downhole tubing rotator along lines 5-5, 6-6, 7-7, 8-8, respectively, in FIG. 4.
Figure 6:
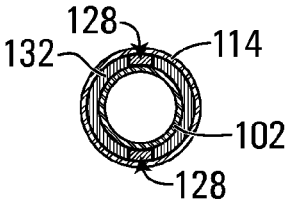
Figure 7:
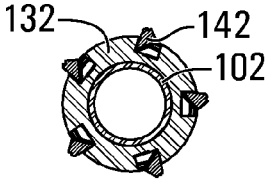
Figure 8:
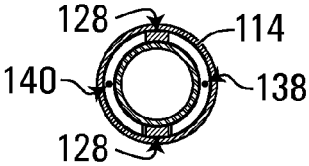
Figure 2:
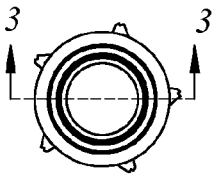
FIG. 2 is another end view of the example downhole tubing rotator.
Figure 9:
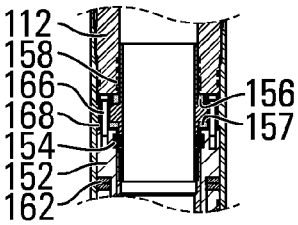
FIG. 9 is a cross-section view of the example downhole tubing rotator along line 9-9 in FIG. 5.
Figure 10:
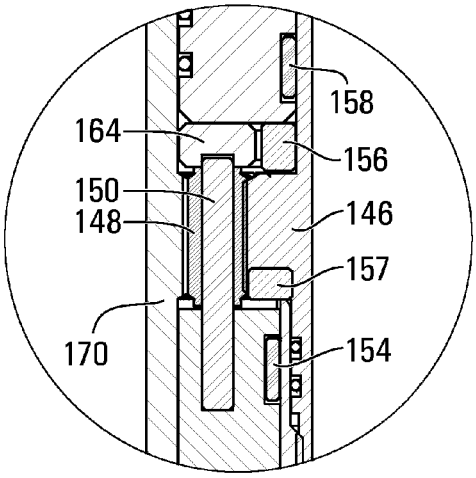
FIGS. 10-12 are detail views indicated in FIG. 3.
Figure 11:
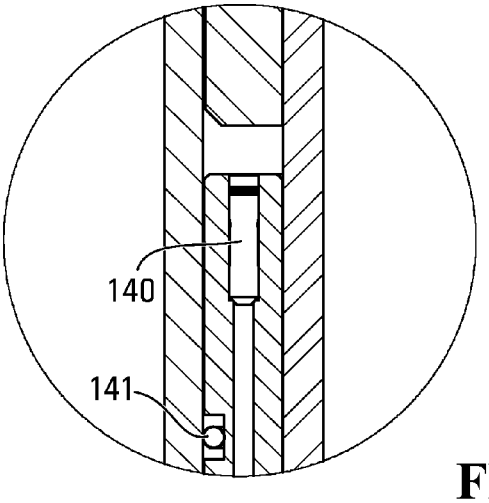
Figure 11:
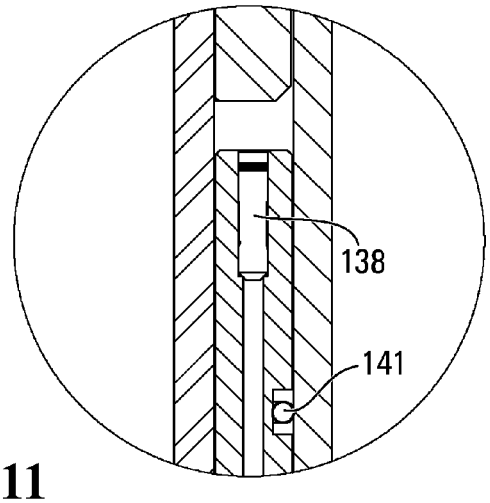
Figure 12:
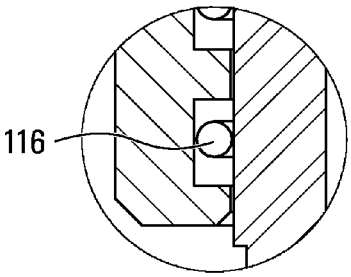
Figure 14:
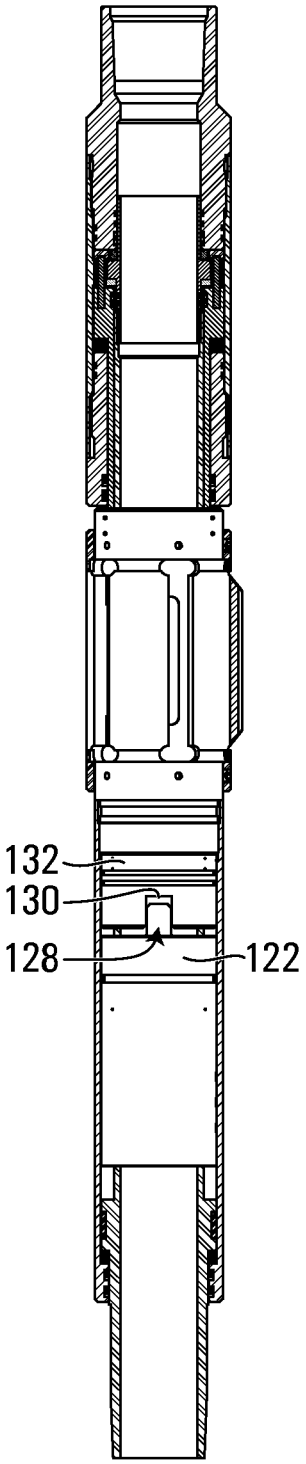
FIGS. 14 to 16 are cross-section views of the example downhole tubing rotator along lines 14-14, 15-15, 16-16, respectively, in FIG. 13, with the following exceptions: the anchor mandrel 132 in FIG. 14, the sleeve 122 in FIGS. 14 and 15, and the mandrel 102 in FIG. 16, which have not been sectioned in order to better illustrate certain features.

As shown perhaps most clearly in FIG. 5, an outer gear of the planetary gear system is formed in an inner surface of a housing 170 that is coupled to the top sub 112. The planet gears 148 mesh with both the central gear on the planetary drive sub 146 and the outer gear in the housing 170. As the planetary drive sub 146 rotates with the mandrel 102, it drives the planet gears 148, which in turn drive the outer gear in the housing 170 in the opposite direction relative to the direction of rotation of the planetary drive sub. The housing 170 is coupled to the top sub 112, by a threaded connection for example, and rotates the top sub and a production tubing string coupled thereto. A gear reduction ratio could be provided by the planetary gear system to rotate the top sub 112 at a lower rate of rotation than the rate of rotation of the mandrel 102.

In the example downhole tubing rotator 100, the top sub 112 is coupled to the mandrel 102 through the housing 170 and the planetary gear system, and the mandrel 102 is coupled to the anchor mandrel 132 through the lugs 128 on the sleeve 122 engaging the lugs or cutouts 130 on the anchor mandrel. If the tubing string coupled to the top sub 112 is rotated, torque from the tubing is transmitted to the anchor mandrel 132 through the top sub, the housing 170 coupled thereto, the planetary gear system, the mandrel 102, and the sleeve 122. The anchor module 106 can thus be set and released by rotating the tubing string in opposite directions. During operation of the PC pump, rotation of the mandrel 102 due to torque from the PC pump stator drives tubing rotation, whereas rotation of the tubing string from the surface drives rotation of the mandrel 102 through the top sub 112, the rotation reversing module 108, and the sleeve 122. Rotation of the tubing string from the surface will cause the sleeve 122 to oscillate as described above. However, to set or release the anchor module 106, the tubing string is rotated much faster than the sleeve 122 can oscillate, and thus the sleeve will also rotate the anchor mandrel 132 through the lugs 128 engaging the cutouts 130.

Most of the features shown in FIGS. 1 to 18 are described above. In order to avoid congestion in the drawings, however, not all of the seals appearing in FIGS. 3 and 4, for example, are labelled with reference numbers or shown in the exploded views in FIGS. 17 and 18. Several of the seals are labelled at 116, 141, 143, and the example downhole tubing rotator 100 includes 20 seals in the embodiment shown.

Figure 19:
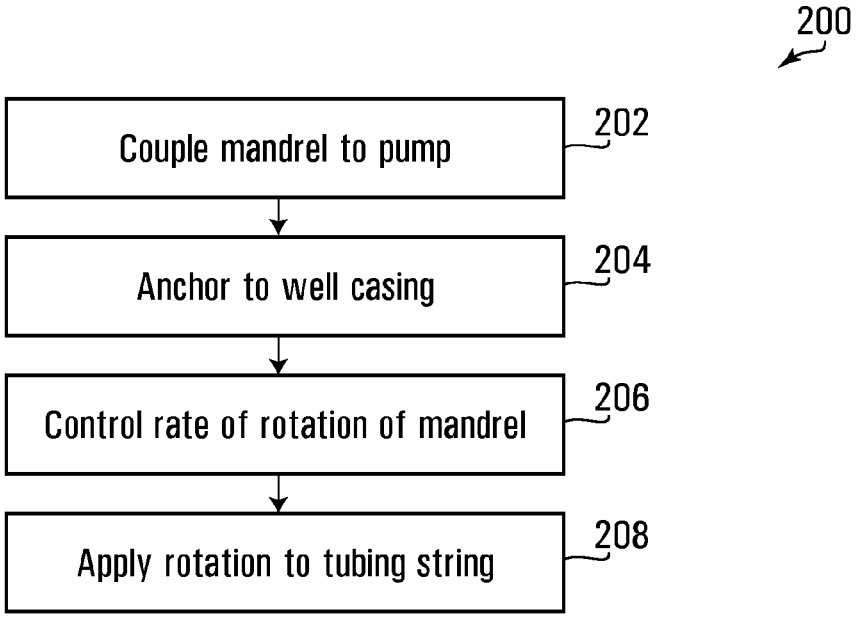
FIG. 19 is a flow diagram of an example method.

The foregoing description relates primarily to the example downhole tubing rotator 100. Other embodiments such as methods are also contemplated. FIG. 19 is a flow diagram of an example method 200, which involves, at 202, coupling a mandrel of a downhole tubing rotator to a production well progressing cavity pump stator; at 204, anchoring the downhole tubing rotator to a well casing; at 206, controlling a rate of rotation of the mandrel due to torque applied to the mandrel by the progressing cavity pump stator; and at 208, applying to a tubing string a rotation in a direction opposite to a direction of rotation of the mandrel due to the torque applied to the mandrel by the progressing cavity pump stator.

Figure 20:
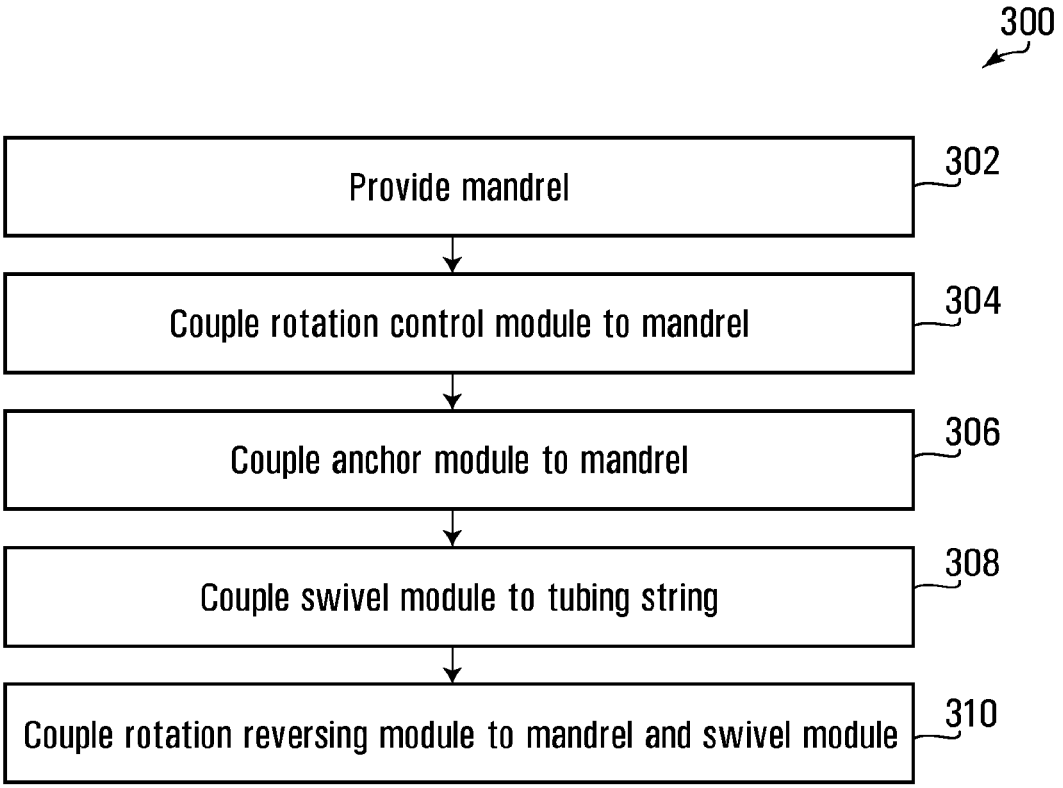
FIG. 20 is a flow diagram of another example method.

FIG. 20 is a flow diagram of another example method 300, which involves, at 302, providing a mandrel to be coupled to a progressing cavity pump stator; at 304, coupling a rotation control module to the mandrel, to control a rate of rotation of the mandrel due to torque applied to the mandrel by the progressing cavity pump stator; at 306, coupling an anchor module to the mandrel to anchor the mandrel to a well casing; at 308, coupling a swivel module to a tubing string to allow the tubing string to rotate independently of the anchor module; and at 310, coupling a rotation reversing module to the mandrel and to the swivel module, to apply to the tubing string a rotation in a direction opposite to a direction of rotation of the mandrel due to the torque applied to the mandrel by the progressing cavity pump stator.

The example methods 200, 300 are illustrative of one embodiment. Examples of additional operations that may be performed are believed to be apparent from the description and drawings relating to the example downhole tubing rotator 100, for example. Further variations in operations that could be performed and/or in the order in which operations are performed may be or become apparent.

A downhole tubing rotator as disclosed herein could be used as a cost effective technology, as part of a production tubing wear prevention solution, to distribute wear around the internal circumference of the production tubing. Such distribution of wear could extend the production tubing life by 6 to 10 times. Also, in wells with paraffin or salts deposit problems, continuous rotation of the tubing string could reduce the chance of the paraffin and salts deposits bridging and obstructing well production. Possible applications include, among others, depleted oilfields, heavy oil wells, CBM (Coal Bed Methane) wells, and wells producing from tight shale formations.

A downhole tubing rotator could be used in conjunction with regular or insert PC pump installations, and does not require any additional power to run. This can significantly reduce the service, maintenance, and operating costs when compared with surface tubing rotators.

No changes to wellhead configuration are required for a downhole tubing rotator as disclosed herein. Since tubing rotation is driven from downhole instead of at the surface, potential leaks at surface around the tubing rotator drive shaft are eliminated since there is no such surface drive. This also eliminates the risks associated with such natural gas and/or oil leaks, both to people and the environment.

What has been described is merely illustrative of the application of principles of embodiments of the present disclosure. Other arrangements and methods can be implemented by those skilled in the art.

For example, the ball bearing coupling between the mandrel 102 and the oscillating sleeve 114 is intended for illustrative purposes. There could be more or fewer ball bearings 124 and races 126, and the races could be of a different shape than shown.

Similar comments apply in respect of other components as well. Other embodiments could include more or fewer components than shown in the example downhole tubing rotator 100. The numbers of seals, flow restrictors, lugs/cutouts, screws, anchor blocks, bearings, glide rings, planet gears, and/or planetary cage spacers, for instance, could vary between different embodiments.

Implementations of various features could also be different than shown and described. For instance, there are other mechanisms that could control rotation rate of the mandrel 102 due to torque from the pump stator. These could include, for example, a re-circulating balls system such as on a reversing linear actuator moving the sleeve 122 back and forth, or a friction braking system operating on a similar principle as the brakes on a vehicle. In an alternate implementation of the rotation reversing module 108, the central gear could be machined or otherwise formed on an outer surface of the mandrel 102 instead of as a separate planetary drive sub 146 connected to the mandrel, and/or the outer gear could be a separate piece attached to the housing 170.

As noted above, modular design with interchangeable modules to address different well configurations. Thus, it is possible that not all modules would be manufactured and/or assembled at the same time. In an embodiment, production well downhole equipment could include a mandrel such as 102 to be coupled to a progressing cavity pump stator, a rotation control module such as 104 to be coupled to the mandrel to control a rate of rotation of the mandrel due to torque applied to the mandrel by the progressing cavity pump stator, and a rotation reversing module such as 108 to be coupled to the mandrel and a tubing string to apply to the tubing string a rotation in a direction opposite to a direction of rotation of the mandrel due to the torque applied to the mandrel by the progressing cavity pump stator. These components could be assembled with other components such as an anchor module and a swivel module for deployment in a production well.

We claim:

1. A downhole tubing rotator comprising:

a mandrel to be coupled to a progressing cavity pump stator;

a rotation control module coupled to the mandrel, to control a rate of rotation of the mandrel due to torque applied to the mandrel by the progressing cavity pump stator;

an anchor module coupled to the mandrel to anchor the downhole tubing rotator to a well casing;

a rotation reversing module coupled to the mandrel, to apply to a tubing string a rotation in a direction opposite to a direction of rotation of the mandrel due to the torque applied to the mandrel by the progressing cavity pump stator;

a swivel module to be coupled to the tubing string to allow the tubing string to rotate independently of the anchor module.

2. The downhole tubing rotator of claim 1, the rotation control module comprising:

a sleeve coupled to move with rotation of the mandrel;

a resistance arrangement to apply resistance to movement of the sleeve.

3. The downhole tubing rotator of claim 2, the sleeve being coupled to the mandrel by ball bearings, one of the mandrel and the sleeve comprising ball races, the ball bearings running along the ball races during rotation of the mandrel.

4. The downhole tubing rotator of claim 3, the ball races translating the rotation of the mandrel into oscillating longitudinal movement of the sleeve along the mandrel.

5. The downhole tubing rotator of claim 4, the sleeve comprising lugs that engage cutouts in the downhole tubing rotator to prevent rotation of the sleeve with the mandrel.

6. The downhole tubing rotator of claim 5, the cutouts comprising cutouts in an anchor mandrel of the anchor module.

7. The downhole tubing rotator of claim 3, the resistance arrangement comprising:

a first hydraulic chamber and a second hydraulic chamber;

a flow path coupling the first hydraulic chamber and the second hydraulic chamber, the ball bearings being located in the flow path;

the sleeve forcing hydraulic fluid between the first hydraulic chamber and the second hydraulic chamber through the flow path as the sleeve moves with rotation of the mandrel.

8. The downhole tubing rotator of claim 2, the resistance arrangement comprising:

a first hydraulic chamber and a second hydraulic chamber;

a flow restrictor on the sleeve, coupling the first hydraulic chamber and the second hydraulic chamber, the sleeve forcing hydraulic fluid between the first hydraulic chamber and the second hydraulic chamber through the flow restrictor as the sleeve moves with rotation of the mandrel.

9. The downhole tubing rotator of claim 8, the resistance arrangement further comprising:

a second flow restrictor on the sleeve, coupling the first hydraulic chamber and the second hydraulic chamber, the flow restrictor and the second flow restrictor comprising unidirectional flow restrictors, the flow restrictor enabling restricted flow of the hydraulic fluid in a first direction between the first hydraulic chamber and the second hydraulic chamber, the second flow restrictor enabling restricted flow of the hydraulic fluid between the first hydraulic chamber and the second hydraulic chamber in a second direction opposite the first direction, the rotation control module translating the rotation of the mandrel into oscillating longitudinal movement of the sleeve along the mandrel, the sleeve alternately forcing the hydraulic fluid between the first hydraulic chamber and the second hydraulic chamber through the flow restrictor in the first direction and through the second flow restrictor in the second direction as the sleeve moves with rotation of the mandrel.

10. The downhole tubing rotator of claim 1, the rotation reversing module comprising a planetary gear system between the mandrel and a top sub of the swivel module, the top sub to be coupled to the tubing string.

11. The downhole tubing rotator of claim 10, the planetary gear system comprising:

a central gear coupled to the mandrel;

an outer gear coupled to the top sub;

planet gears that mesh with the central gear and the outer gear.

12. The downhole tubing rotator of claim 11, the central gear comprising a planetary drive sub coupled to the mandrel.

13. The downhole tubing rotator of claim 12, the planetary gear system providing a gear ratio reduction to rotate the top sub at a lower rate of rotation than the rate of rotation of the mandrel.

14. The downhole tubing rotator of claim 11, the outer gear comprising a gear formed in an inner surface of a housing coupled to the top sub.

15. A method comprising:

coupling a mandrel of a downhole tubing rotator to a production well progressing cavity pump stator;

anchoring the downhole tubing rotator to a well casing;

controlling a rate of rotation of the mandrel due to torque applied to the mandrel by the progressing cavity pump stator;

applying to a tubing string a rotation in a direction opposite to a direction of rotation of the mandrel due to the torque applied to the mandrel by the progressing cavity pump stator.

16. The method of claim 15, the controlling comprising:

applying resistance to the rotation of the mandrel.

17. The method of claim 16, the applying resistance comprising:

translating the rotation of the mandrel into oscillating longitudinal movement of a sleeve along the mandrel;

applying the resistance to the oscillating longitudinal movement of the sleeve.

18. The method of claim 15, the controlling comprising hydraulically reducing the rate of rotation of the mandrel.

19. The method of claim 18, the hydraulically reducing comprising forcing hydraulic fluid between a first hydraulic chamber and a second hydraulic chamber through a flow restrictor as the mandrel rotates.

20. The method of claim 15, the applying comprising:

driving a central gear of a planetary gear system with the mandrel;

driving an outer gear, coupled to the tubing string, with planet gears that mesh with the central gear and the outer gear.

21. A method comprising:

providing a mandrel to be coupled to a progressing cavity pump stator;

coupling a rotation control module to the mandrel, to control a rate of rotation of the mandrel due to torque applied to the mandrel by the progressing cavity pump stator;

coupling an anchor module to the mandrel to anchor the mandrel to a well casing;

coupling a swivel module to a tubing string to allow the tubing string to rotate independently of the anchor module;

coupling a rotation reversing module to the mandrel and to the swivel module, to apply to the tubing string a rotation in a direction opposite to a direction of rotation of the mandrel due to the torque applied to the mandrel by the progressing cavity pump stator.

22. Production well downhole equipment comprising:

a mandrel to be coupled to a progressing cavity pump stator;

a rotation control module to be coupled to the mandrel, to control a rate of rotation of the mandrel due to torque applied to the mandrel by the progressing cavity pump stator;

a rotation reversing module to be coupled to the mandrel and a tubing string, to apply to the tubing string a rotation in a direction opposite to a direction of rotation of the mandrel due to the torque applied to the mandrel by the progressing cavity pump stator.

* * * * *